US008317574B2

(12) United States Patent
Blickle et al.

(10) Patent No.: US 8,317,574 B2
(45) Date of Patent: Nov. 27, 2012

(54) POWER-DRIVEN HAND TOOL WITH CLAMPING FIXTURE FOR A TOOL

(75) Inventors: Juergen Blickle, Goeppingen (DE); Uwe Frueh, Sonnenbuehl (DE)

(73) Assignee: C. & E. Fein GmbH (DE)

( * ) Notice: Subject to any disclaimer, the term of this patent is extended or adjusted under 35 U.S.C. 154(b) by 298 days.

(21) Appl. No.: 12/696,697

(22) Filed: Jan. 29, 2010

(65) Prior Publication Data

US 2010/0197208 A1 Aug. 5, 2010

(30) Foreign Application Priority Data

Jan. 30, 2009 (DE) ..... 20 2009 001 440 U

(51) Int. Cl.
*B24B 27/08* (2006.01)

(52) U.S. Cl. ..... 451/353; 451/359; 451/344; 294/94

(58) Field of Classification Search ..... 451/353, 451/359, 442, 444, 342, 344; 294/94
See application file for complete search history.

(56) References Cited

U.S. PATENT DOCUMENTS

| | | | | | |
|---|---|---|---|---|---|
| 4,016,684 | A | * | 4/1977 | Urda | 451/344 |
| 4,989,374 | A | * | 2/1991 | Rudolf et al. | 451/342 |
| 5,018,314 | A | * | 5/1991 | Fushiya et al. | 451/357 |
| 5,058,909 | A | * | 10/1991 | Rudolf et al. | 279/8 |
| 5,157,873 | A | * | 10/1992 | Rudolf et al. | 451/342 |
| 5,158,331 | A | | 10/1992 | Wesselski et al. | |
| 5,165,204 | A | * | 11/1992 | Luedeke et al. | 451/342 |
| 5,496,207 | A | * | 3/1996 | Hornung et al. | 451/357 |
| 5,601,483 | A | | 2/1997 | Rudolf et al. | |
| 6,193,592 | B1 | * | 2/2001 | Grupe | 451/344 |
| 6,569,001 | B2 | | 5/2003 | Rudolf et al. | |
| 7,013,987 | B2 | * | 3/2006 | Nock et al. | 173/213 |
| 7,175,513 | B2 | * | 2/2007 | Folin | 451/359 |
| 7,438,634 | B2 | * | 10/2008 | Habele | 451/359 |
| 7,610,968 | B1 | * | 11/2009 | Honsa | 173/211 |
| 7,856,724 | B2 | * | 12/2010 | Hartmann | 30/388 |
| 7,997,586 | B2 | * | 8/2011 | Ziegler et al. | 279/8 |
| 2002/0035882 | A1 | * | 3/2002 | Hartmann | 74/107 |
| 2003/0190877 | A1 | * | 10/2003 | Gallagher et al. | 451/344 |
| 2007/0060030 | A1 | * | 3/2007 | Pollak et al. | 451/359 |
| 2009/0023371 | A1 | * | 1/2009 | Blickle et al. | 451/359 |

FOREIGN PATENT DOCUMENTS

| | | | |
|---|---|---|---|
| EP | 0650805 | A1 | 5/1995 |
| EP | 1180416 | A2 | 2/2002 |
| EP | 1517050 | A1 | 3/2005 |
| WO | 2005102605 | A1 | 11/2005 |

OTHER PUBLICATIONS

European Search Report; Application No. EP 10 15 2058; May 3, 2010; 5 pages.

* cited by examiner

*Primary Examiner* — George Nguyen
(74) *Attorney, Agent, or Firm* — St. Onge Steward Johnston & Reens LLC

(57) ABSTRACT

A power-driven hand tool is disclosed comprising a housing, a work spindle for driving a tool, which tool can be located between a tool end of the work spindle and a fixing mechanism, further comprising a displacing mechanism with a clamping lever, adapted to pivot about a pivot axis for displacing the fixing mechanism between a releasing position, in which the fixing mechanism can be released from the work spindle, and a clamping position in which the fixing mechanism is clamped on the work spindle by a spring. An impeding mechanism is provided that interacts with the clamping lever for impeding the pivoting movement of the clamping lever between the releasing position and the clamping position.

17 Claims, 4 Drawing Sheets

POWER-DRIVEN HAND TOOL WITH CLAMPING FIXTURE FOR A TOOL

BACKGROUND OF THE INVENTION

The present invention relates to a power-driven hand tool having a housing, a work spindle, adapted to drive a tool which can be located between a tool end of the work spindle and a fixing element, having a displacing mechanism with a clamping lever, adapted to pivot about a pivot axis for displacing the fixing element between a releasing position, in which the fixing element can be released from the work spindle, and a clamping position in which the fixing element is clamped on the work spindle by a spring.

A power-driven hand tool of that kind, having a clamping fixture that serves to manually clamp a tool, has been known from WO 2005 102605 A1.

The known hand tool may be an angle grinder or a hand tool with a work spindle that can be driven in oscillating fashion. The hand tool comprises a hollow work spindle with a clamping shaft arranged to be displaced inside the spindle, which can be displaced between a clamping position and a releasing position by a clamping fixture. In the clamping position, a tool, for example a grinding wheel, is clamped on the work spindle, on a mounting section, and is retained in that position by spring force once the clamping fixture has been moved to the clamping position.

A clamping fixture of that kind works satisfactorily for clamping a tool for the described applications. However, it has been found that although reliable clamping of the tool is ensured, handling of the displacing mechanism, for switching over the tool from the releasing position to the clamping position, is impaired. The design of the displacing mechanism is such that safe clamping of the tool on the work spindle is automatically guaranteed as soon as the clamping lever is pivoted out of the releasing position. That movement releases forces which abruptly transfer the clamping lever to is clamping position. That rapid abrupt transfer of the clamping lever influences the ease of handling negatively.

SUMMARY OF THE INVENTION

In view of this it is a first object of the present invention to disclose a power-driven hand tool of the above-mentioned kind which provides easy handling.

It is a second object of the invention to disclose a power tool which provides for reliable mounting of the tool.

It is a third object of the invention to disclose a power tool which allows the tool to be changed easily.

According to the invention these and other objects are achieved by a power-driven hand tool of the before-mentioned kind wherein an impeding mechanism, interacting with the clamping lever, is provided for braking the pivoting movement of the clamping lever between the releasing position and the clamping position.

According to the invention, the transfer movement of the clamping lever from the releasing position to the clamping position can be influenced to prevent the clamping lever from changing its position abruptly. In this way, handling is made easier, while on the other hand the chucking reliability of the tool is preserved. Tool changes remain easy as well.

In the context of the present application, the term releasing position is meant to describe that position of the displacing mechanism in which the fixing element has been displaced to a position in which the tool can be released. Accordingly, the clamping position is that position in which the arrangement of the displacing mechanism and the fixing element is such that safe clamping of the tool on the work spindle is ensured.

According to another embodiment of the invention, the impeding mechanism comprises at least one elastic braking element and a matching contour that can be moved relative to that element.

This has the result that the force necessary for braking the pivoting movement of the clamping lever can be applied in a controlled manner by a counter-contour of geometrically simple design, depending on the momentary position relative to the braking element. Any abrupt switching-over of the clamping lever between the releasing position and the clamping position is prevented in this way. Tool changes are made easier.

According to an advantageous further development of the invention, the configuration of the counter-contour in a pivoting zone of the clamping lever between the releasing position and the clamping position is selected to ensure frictional engagement with the braking element.

In this way, any rapid transfer of the clamping lever between the releasing position and the clamping position can be prevented by application of a force, via frictional engagement between the counter-contour and the braking element, that brakes the movement of the clamping lever between the releasing position and the clamping position. This leads to improved ease of handling of the hand tool.

According to an advantageous further development of the invention, the counter-contour has a position of rest for the braking element in the clamping position of the clamping lever.

The clamping position is thereby additionally secured by the braking element. There is no need for any further elements to secure the clamping position of the clamping lever so that the cost of the hand tool is further reduced.

Further, interaction between the counter-contour with the position of rest and the braking element in the clamping position of the clamping lever permits the clamping position to be secured without any need for an additional force to be applied by the braking element. This can be made possible by having the braking element overcome a dead center on the counter-contour, where the braking element is subjected to the greatest elastic deformation, whereafter it can be substantially relaxed in a position of rest. For leaving the position of rest, the dead center has to be overcome once more.

It is possible in this way to prevent any influence of the braking element on the clamping position, in which the tool is clamped by the spring between the tool end of the work spindle and the fixing element. Reliable clamping of the tool is ensured in this case as well.

According to another embodiment of the invention, the braking element is configured as a metal spring.

The braking element of the impeding mechanism in this case may consist of a leaf spring made from flat stock, or of a bending or torsion spring made from round stock. This allows a low-cost structure of the hand tool to be realized.

According to another embodiment of the invention, the counter-contour is provided on the clamping lever, the braking element on the housing.

This simplifies the structure of the hand tool still further, it being now possible to allow for the counter-contour immediately during production of the clamping lever. This leads to a low-cost structure of the hand tool.

According to a convenient further development of the invention, the counter-contour is disposed on a circumferential area of the clamping lever radially offset from the pivoting axis.

As a result of that arrangement, the impeding mechanism requires only little space laterally of the clamping lever. The elements of the impeding mechanism may be covered and protected by the clamping lever in the releasing position or in the clamping position.

According to a further development of the invention, the counter-contour is provided on a lateral surface of the clamping lever.

This may be of advantage for production reasons; in mold production of the clamping lever, for example, the counter-contour and the contour for the pivoting axis can be removed from the mold in one direction of the tool. Further, little space is required for the impeding mechanism in the radial circumferential area.

According to an alternative embodiment of the invention, the braking element is disposed on the clamping lever, the counter-contour on the housing.

As a result of that feature, the counter-contour may be disposed directly on the housing during production of the housing. This may simplify the structure of the hand tool.

According to another embodiment of the invention, the braking element is disposed on the pivot axis.

It is possible in this way to seat and to axially secure the braking element on the pivot axis. There is no need for any additional fixing elements for the braking element. This permits a low-cost, further simplified structure of the hand tool to be realized.

It is understood that the features of the invention mentioned above and those yet to be explained below can be used not only in the respective combination indicated, but also in other combinations or in isolation, without leaving the scope of the invention.

BRIEF DESCRIPTION OF THE DRAWINGS

Further features and advantages of the invention will become apparent from the description that follows of preferred embodiments, with reference to the drawing. In the drawing.

DETAILED DESCRIPTION OF THE PREFERRED EMBODIMENTS

Figure 1:
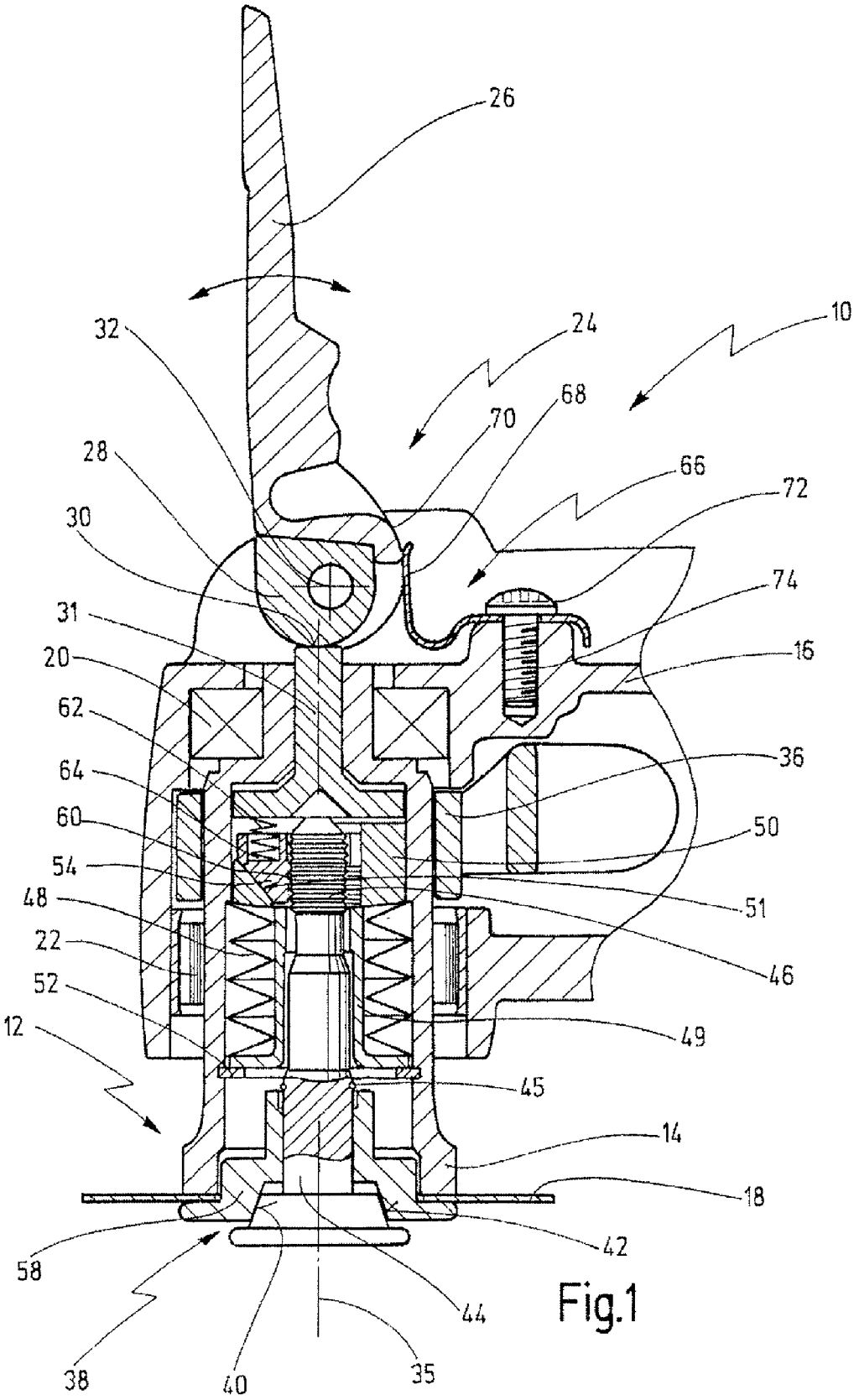
FIG. 1 shows a sectioned representation of a first embodiment of a hand tool according to the invention with an oscillatory drive in the gearhead area, with a clamping lever in a position between the releasing position and the clamping position.

FIG. 1 shows a sectioned view of the gearhead area of a power-driven hand tool according to the invention, indicated generally by reference numeral 10. The hand tool 10 has an oscillating drive for driving the tool in oscillating fashion, over a small pivoting angle and at high frequency, about the longitudinal axis 35 of a work spindle 12. Oscillating drives of that kind are in use for numerous special jobs, for example for cutting out vehicle panes by knives driven in oscillating fashion, for sawing using oscillating saw knives, for grinding and for many other similar jobs. Alternatively, it may also be an angle grinder with a rotary work spindle.

The work spindle 12 comprises a spindle tube 14 which is seated in the housing 16 via a bearing 20 in its upper region and via a bearing 22 in its lower region.

For mounting the tool 18 on the outer end of the spindle tube 14, there is provided a fixing mechanism 38 indicated generally by reference numeral 38, which engages an opening of the tool 14 and which is clamped in the clamping position on the work spindle 12 by a clamping shaft 44 in a manner such that the tool 18 is clamped against the outer end of the spindle tube 14 via a clamping sleeve 58. For transmission of the clamping forces, an inner flange 42 and an outer flange 40 are provided on the clamping sleeve 58 and on the clamping shaft 44. The clamping sleeve 58 is arranged on the clamping shaft 44 and is secured in that position by a snap ring 45.

The clamping force required for clamping the tool 18 is applied via a spring 48 which is designed as a cup spring assembly. A spring 48 is arranged in the spindle tube 14 and is guided on a spring bush 49 which is axially secured in the spindle tube 14 by a securing element 52. The spring 48 generates a force in the longitudinal direction of the clamping shaft 44 which is directed toward a clamping sleeve 50. The circumference of the clamping sleeve 50 is provided with notches in which clamping pieces 54 are guided along an inclined surface 51. Advantageously, three or four notches with inclined surfaces 51 and clamping pieces 54 are distributed at regular angular spacing over the circumference of the clamping sleeve 50. The clamping shaft 44 is provided with a toothing 46 in the area of the clamping sleeve 50. The clamping pieces 54 are provided with a corresponding counter-toothing 60. As a result of the force applied by the spring 48, the clamping sleeve 40 is displaced in lengthwise direction of the clamping shaft 44. The force components arising at the inclined surface 41 are directed, on the one hand, axially relative to the longitudinal direction 35 and, on the other hand, radially relative to the longitudinal axis 35. The radial components produce a frictional engagement in addition to the form-locking engagement between the matching toothing 46 and the counter-toothing 60. The axial component leads to axial displacement of the clamping pieces 54 and, accordingly, also to displacement of the fixing mechanism 38 in a direction toward the lower end of the spindle tube 14. This has the effect to transmit the clamping force to the clamping sleeve 58 and the tool 18, and to secure the fixing mechanism by frictional engagement.

The clamping pieces 54 are provided at their upper ends with bores 64 in which springs 62 are arranged. The springs 62 interact with a thrust piece 31 arranged for being displaced in longitudinal direction in the upper section of the spindle tube 14.

The thrust piece 31 comprises a contact surface 30 at its upper end. The contact surface 30 interacts with an eccentric 28, which is part of a displacing mechanism indicated generally by 24. The displacing mechanism 24 is pivotally seated on a pivot axis 32. The displacing mechanism 24 comprises a clamping lever 26 through which the pivoting movement of the eccentric 28 about the pivot axis 32 is transmitted.

An impeding mechanism, indicated generally by 66, is arranged beside the displacing mechanism 24. The impeding mechanism 66 comprises an impeding element 68 that interacts with a counter-contour 70 associated to the clamping lever 26. The braking element 68, having the form of a bent leaf spring, is fixed on the housing 16 by a fixing element 72 in the form of a screw screwed into the thread 74.

As can be seen in FIG. 1, the longitudinal axis 35 and the pivot axis 32, arranged vertically relative to the latter, are offset one relative to the other. That offset, and the configuration of the eccentric 28 in the illustrated position of the clamping lever 46, together with the force of the spring 48 that is transferred to the thrust piece 31 via the clamping sleeve 50, produce a swinging moment in clockwise direction about the pivot axis 32. That swinging moment assists the clamping lever 26 in pivoting from a releasing position to a clamping position. This guarantees safe and reliable clamping of the tool 18. The pivoting movement occurs very abruptly. In the position of the clamping lever 26 illustrated in FIG. 1, the braking element 68 gets into contact with a counter-contour 70 on the clamping lever 26. The braking force so produced has the effect to brake the abrupt pivoting movement.

It is understood that the rapid switching-over movement of the clamping lever 26 may also be provoked by circumstances other than those that have been described before by way of example.

Figure 2:
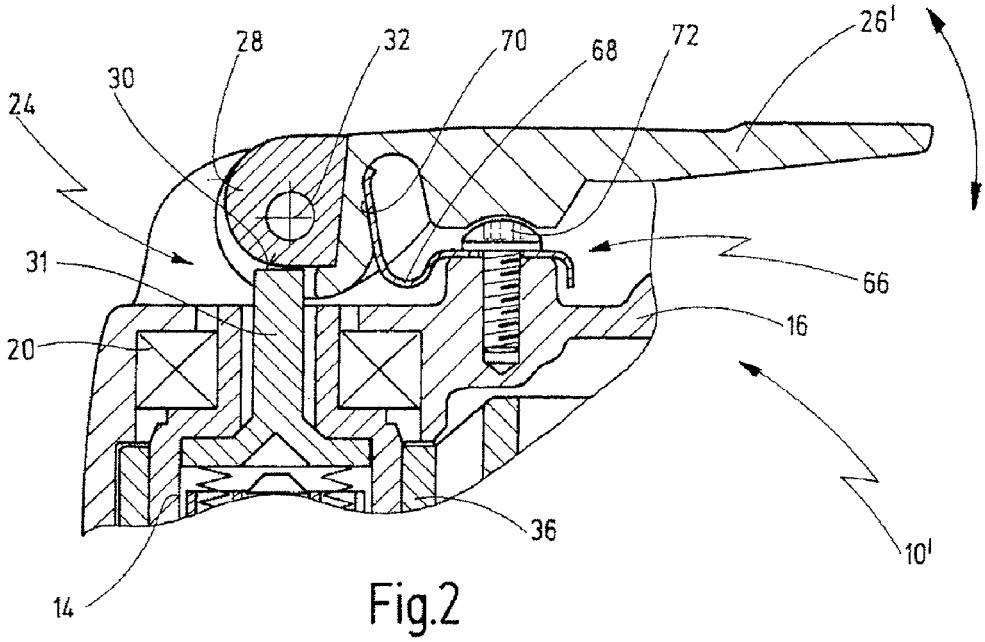
FIG. 2 shows the hand tool according to FIG. 1 in the clamping position.

In FIG. 2, the hand tool according to the invention shown in FIG. 1 is illustrated in a clamping position, marked by the new position of the clamping lever 26', and is indicated generally by 10'. In the illustrated clamping position, no contact exists between the eccentric 28 and the contact surface 30 of the thrust piece 31. Consequently, the clamping lever 26' must be guided on its pivoting path to avoid any undesired pivoting movement. The counter-contour 70 has a dead center, i.e. a point where the spacing from the pivot axis 32 is at its maximum, which has to be overcome by the braking element 68 when the clamping lever 26 is being transferred to the clamping position. Now, as can be seen in FIG. 2, a rest position is provided in which the braking element 68 is substantially relaxed. When the braking element 68 leaves that rest position, it once more has to overcome the dead center on the counter-contour 70. Consequently, the clamping lever 26' is secured in its position. In the clamping position of the clamping lever 26', the impeding mechanism 60 is covered by the clamping lever 26' so that it is not visible from the outside.

Figure 3:
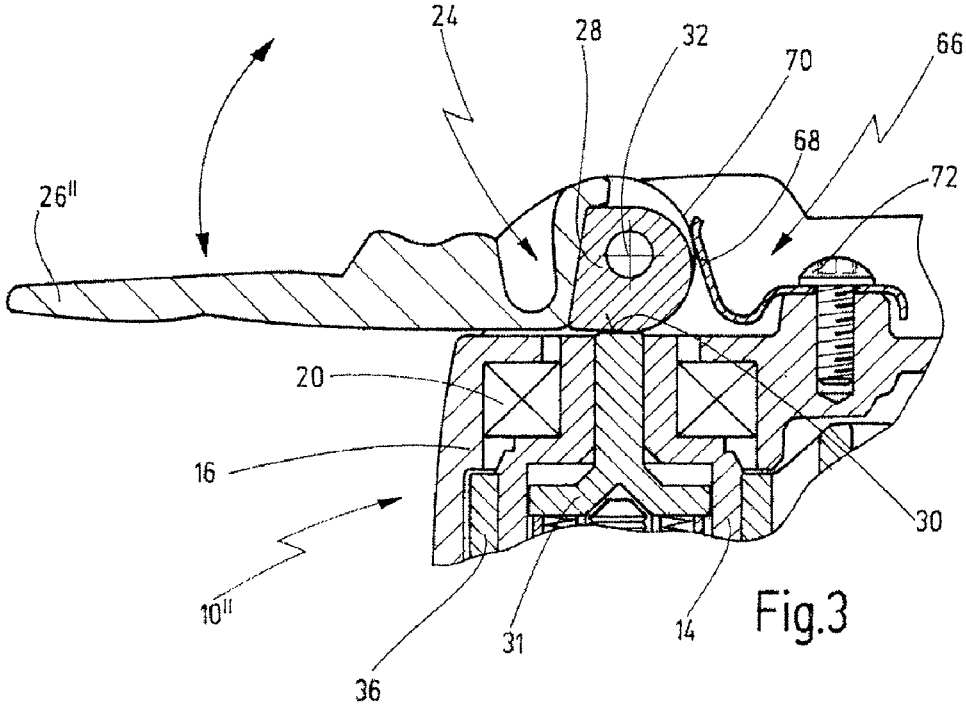
FIG. 3 shows the hand tool according to FIG. 1 in the releasing position.

In FIG. 3, the hand tool from FIG. 1 is illustrated in a releasing position, in which the tool can be released, illustrated by the position of the clamping lever 26", and is indicated generally by 10". The displacement of the thrust piece 31, required for releasing the tool, is provided by the contact between the surface 30 of the thrust piece 31 and the eccentric 28 in the area of its greatest radial extension. The thrust piece 31 displaces the clamping sleeve 50 toward the spring 48 in such a way that no contact remains between the clamping sleeve 50 and the thrust piece 54 along the inclined surface 51 (not shown in this Figure). A pulling force applied on the fixing mechanism 38 will therefore cause the toothing 46 of the clamping shaft 44 to be disengaged axially from form-locking contact with the counter-toothing, and the thrust pieces 54 to be displaced radially to the outside. The fixing mechanism 38 can be removed from the opening of the spindle tube 14, and the tool 18 can be changed.

Figure 4:
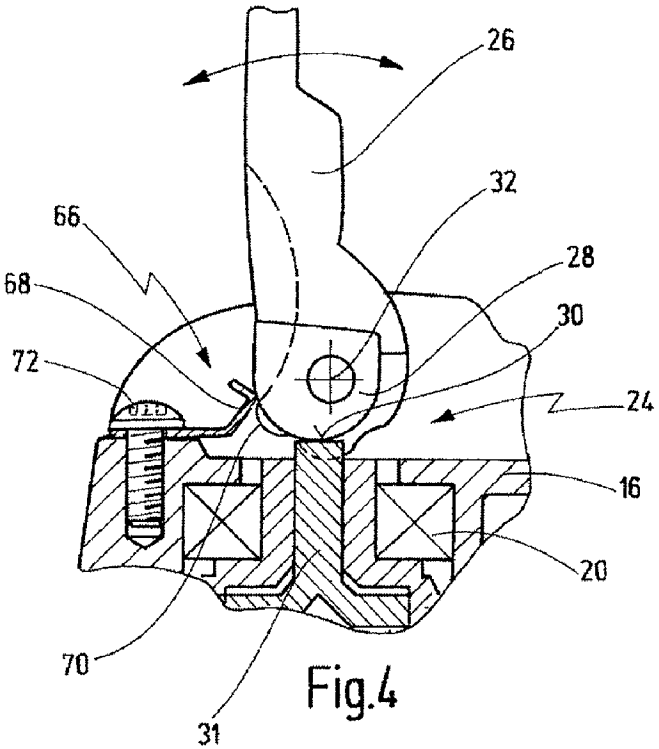
FIG. 4 shows a partial sectioned view of a second embodiment of a hand tool according to the invention.

FIG. 4 shows a second embodiment of a hand tool according to the invention. The clamping lever 26 is again shown in a pivoting position between the releasing position and the clamping position. The impeding mechanism 66, equipped with an impeding element 68 configured as a bent leaf spring and a fixing element 72, is arranged near the end face of the housing 16 of the hand tool, at a radial distance from the picot axis 32. The impeding mechanism 66 is concealed by the clamping lever 26 in the releasing position of the clamping lever 26. The counter-contour 76 is again formed on a circumferential area of the clamping lever 26 which Is radially offset relative to the pivot axis 32 and which is provided, by way of example, with a geometry that matches the braking element 68. In the illustrated position of the clamping lever 26, the braking element 68 and the counter-contour 70 arc in frictional engagement one with the other so that any rapid switching-over movements of the clamping lever 26, between the releasing position and the clamping position, are braked.

Figure 5:
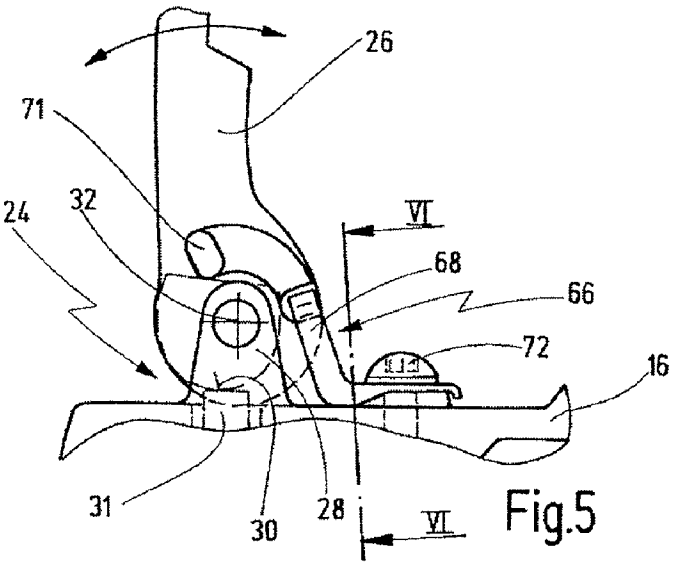
FIG. 5 shows a partial sectioned view of a third embodiment of a hand tool according to the invention.
Figure 6:
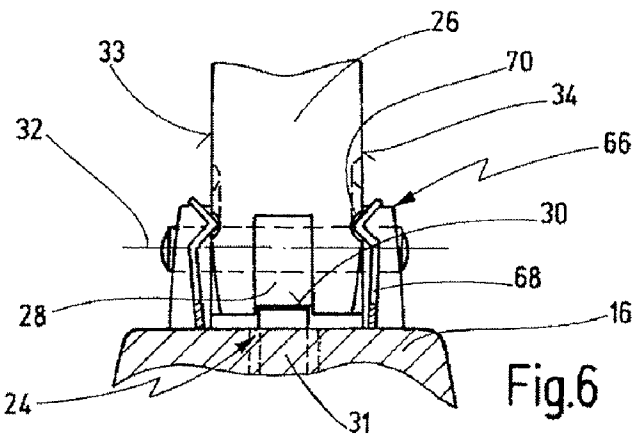
FIG. 6 shows a partial sectioned view of the hand tool according to FIG. 5, sectioned in part along line VI-VI.

A third embodiment of a hand tool according to the invention is illustrated in FIG. 5 and, in a view sectioned along line VI-VI in FIG. 5, in FIG. 6. Again, the clamping lever 26 is shown in a pivoting position between the releasing position and the clamping position. The impeding mechanism 36 again comprises an impeding element 68 configured as a bent leaf spring. The counter-contour 70 is arranged along two lateral surfaces 33 and 34 of the clamping lever 26, while the eccentric 28 is again formed on a circumferential area of the clamping lever 26 that is radially offset from the pivot axis 32. The counter-contour 70 again is configured so as to interact with the braking element, regardless of its particular position. Rest positions, intended to secure the clamping lever 26 in different positions, are indicated in FIGS. 5 and 6 by recesses 71 in the lateral surfaces 33 and 34.

Figure 7:
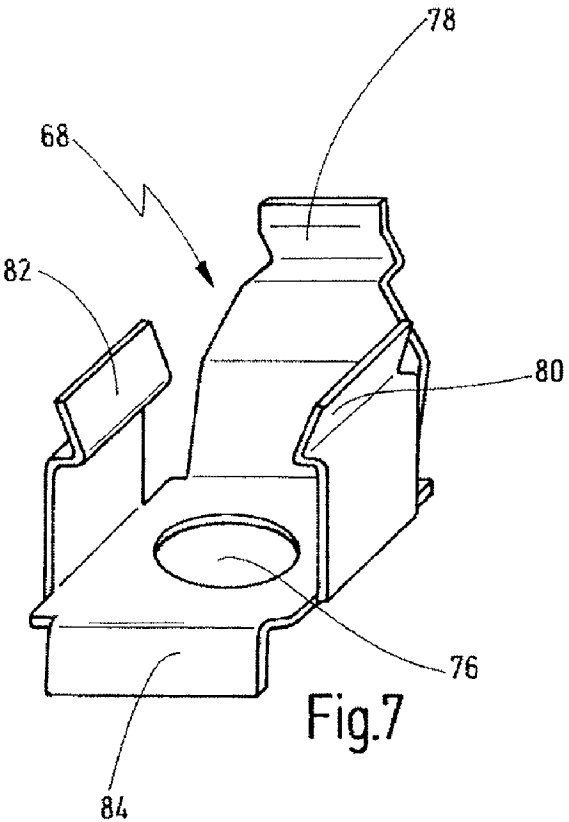
FIG. 7 shows an enlarged view of an impeding element according to the invention.

FIG. 7 shows an enlarged representation of an impeding element 68 according to the invention. The element shown is a bent leaf spring. The braking element 68 comprises a bore 76 through which a fixing element 72 can be passed. Further, there are provided a spring section 78 near the end face and two lateral spring sections 80 and 82. The spring section 78 near the end face interacts with a counter-contour 70 formed on a circumferential area of the clamping lever 26 that is radially offset from the pivot axis 32. The lateral spring sections 80 and 82 engage the counter-contour 70 disposed on the lateral surfaces 33, 34 of the clamping lever 26. The two lateral spring sections 80 and 82 and the spring section 78 near the end face allow many interacting matching combinations to be realized so that braking of the pivoting movement can be made more pronounced and can be controlled more targetfully. Alternatively it is imaginable to provide, for example, that the spring section 78 near the end face only serves to realize the frictional interaction with the clamping lever 26 in the pivoting area between the releasing position and the clamping position, while the lateral spring sections 80 and 82 only serve to realize the interaction with the rest positions on the counter-contour 70, for securing the clamping lever 26 in its clamping position. The illustrated braking element 68 additionally comprises a form-locking element 84 intended to secure the positional orientation and to act as a locating and anti-rotation element on the housing 16.

Figure 8:
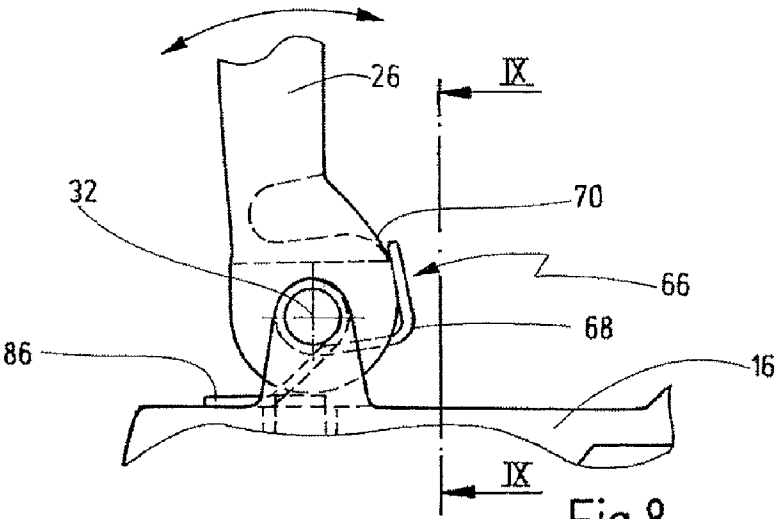
FIG. 8 shows a partial sectioned view of a fourth embodiment of a hand tool according to the invention.
Figure 9:
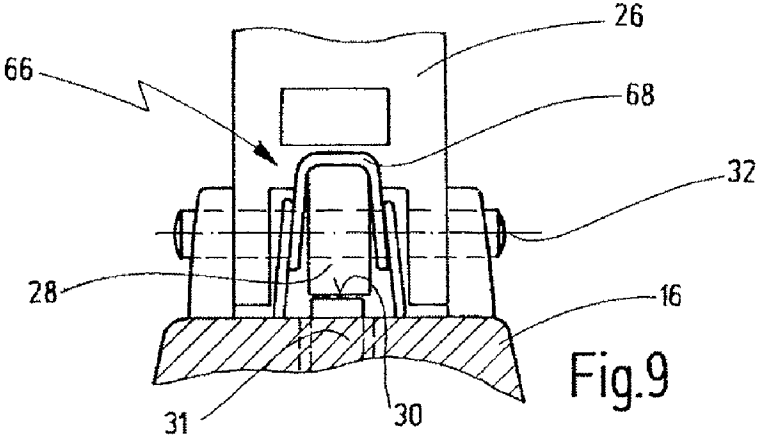
FIG. 9 shows a partial sectioned view of a hand tool according to FIG. 8, along line IX-IX.

A fourth embodiment of a hand tool according to the invention is illustrated in FIG. 8 and, by a view sectioned along line IX-IX in FIG. 8, in FIG. 9. The clamping lever 26 again is shown in a pivoting position between the releasing position and the clamping position. The braking element 68, being configured as a bent wire spring, is arranged on the pivot axis 32. The braking element 68 comprises an end portion 86 by which it is supported on the housing 16. The braking element 68 again gets into contact with a counter-contour 70 formed on a circumferential area of the clamping lever 26 that is radially offset from the pivot axis 32. Again, interaction between the braking element 68 and the counter-contour 70, irrespective of the momentary position, is rendered possible.

What is claimed is:

1. A power-driven hand tool comprising:
a housing;
a work spindle for driving a tool;
a tool end provided on said work spindle;
a fixing mechanism for fixing a tool between said fixing mechanism and said tool end;
a displacing mechanism having a clamping lever configured for pivoting about a pivot axis for displacing said fixing mechanism between a releasing position, in which said fixing mechanism can be released from said work spindle, and a clamping position in which said fixing mechanism is clamped on said work spindle by means of a spring; and
an impeding mechanism, interacting with said clamping lever for impeding the pivoting movement of said clamping lever between said releasing position and said clamping position;
wherein said impeding mechanism comprises:
at least one elastic impeding element configured as a metal spring; and
a counter-contour configured for moving relative to said elastic impeding element;
wherein said counter-contour is configured for frictionally engaging said elastic impeding element along the entire range between said releasing position and said clamping position; and
wherein said counter-contour comprises a locking element for locking said impeding element when being in said clamping position.

2. The hand tool of claim 1, wherein said counter-contour is provided on said clamping lever in a pivoting region between said releasing position and said clamping position so as to effect frictional engagement between said counter-contour and said elastic impeding element.

3. The hand tool of claim 2, wherein said counter-contour is provided on said clamping lever, and wherein said impeding element is provided on said housing.

4. The hand tool of claim 3, wherein said counter-contour is disposed on a circumferential area of said clamping lever radially offset from said pivoting axis.

5. The hand tool of any of claim 1, wherein said impeding element is disposed on said pivot axis.

6. The hand tool of claim 1, wherein said counter-contour is provided on a lateral surface of said clamping lever.

7. A power-driven hand tool comprising:
a housing;
a work spindle for driving a tool;
a tool end provided on said work spindle;
a fixing mechanism for fixing a tool between said fixing mechanism and said tool end;
a displacing mechanism having a clamping lever configured for pivoting about a pivot axis for displacing said fixing mechanism between a releasing position, in which said fixing mechanism can be released from said work spindle, and a clamping position in which said fixing mechanism is clamped on said work spindle by means of a spring; and
an impeding mechanism, interacting with said clamping lever for impeding the pivoting movement of said clamping lever along the entire range between said releasing position and said clamping position;
wherein said impeding mechanism comprises at least one elastic impeding element made of metal and a counter-contour that can be moved relative to said elastic impeding element.

8. The hand tool of claim 7, wherein said counter-contour has a position of rest for the impeding element for securing said impeding element when being in said clamping position.

9. The hand tool of claim 7, wherein said impeding element is configured as a metal spring.

10. The hand tool of claim 7, wherein said impeding element is disposed on said pivot axis.

11. A power-driven hand tool comprising:
a housing;
a work spindle for driving a tool;
a tool end provided on said work spindle;
a fixing mechanism for fixing a tool between said fixing mechanism and said tool end;
a displacing mechanism having a clamping lever configured for pivoting about a pivot axis for displacing said fixing mechanism between a releasing position, in which said fixing mechanism can be released from said work spindle, and a clamping position in which said fixing mechanism is clamped on said work spindle by means of a spring; and
an impeding mechanism, comprising at least one elastic impeding element made of metal interacting with said clamping lever for impeding the pivoting movement of said clamping lever along the entire range between said releasing position and said clamping position.

12. The hand tool of claim 11, wherein a counter-contour is provided on said clamping lever in a pivoting region between said releasing position and said clamping position so as to effect frictional engagement between said counter-contour and said elastic impeding element.

13. The hand tool of claim 11, wherein said counter-contour comprises a locking element for locking said impeding element when being in said clamping position.

14. The hand tool of claim 11, wherein said impeding mechanism comprises at least one elastic impeding element and a counter-contour that can be moved relative to said elastic impeding element.

15. The hand tool of claim 14, wherein said counter-contour is provided on said clamping lever in a pivoting region between said releasing position and said clamping position so as to effect frictional engagement between said counter-contour and said elastic impeding element.

16. The hand tool of claim 11, wherein said counter-contour has a position of rest for the impeding element for securing said impeding element when being in said clamping position.

17. A power-driven hand tool comprising:
a housing;
a work spindle for driving a tool;
a tool end provided on said work spindle;
a fixing mechanism for fixing a tool between said fixing mechanism and said tool end;
a displacing mechanism having a clamping lever configured for pivoting about a pivot axis for displacing said fixing mechanism between a releasing position, in which said fixing mechanism can be released from said work spindle, and a clamping position in which said fixing mechanism is clamped on said work spindle by means of a spring; and
an impeding mechanism, interacting with said clamping lever for impeding the pivoting movement of said clamping lever along the entire range between said releasing position and said clamping position;
wherein said impeding mechanism comprises at least one elastic impeding element made of metal and a counter-contour that can be moved relative to said elastic impeding element;
and wherein said impeding mechanism further comprises a locking element for locking said impeding element when being in said clamping position.

* * * * *